US006053792A

United States Patent [19]

Sallee et al.

[11] Patent Number: 6,053,792

[45] Date of Patent: Apr. 25, 2000

[54] PLAYHOUSE WITH STORY TELLING FUNCTION

[76] Inventors: Teresa K. Sallee; Jack L. Sallee, both of 22351 Sibley Rd., Wyandotte, Mich. 48192

[21] Appl. No.: 09/130,609

[22] Filed: Aug. 6, 1998

[51] Int. Cl.[7] ..... A63H 5/00; A63H 33/30; A63H 3/52; E04H 15/00

[52] U.S. Cl. ..... 446/81; 446/404; 446/477; 434/245; 135/87; D21/506

[58] Field of Search ..... 446/81, 82, 404, 446/476, 477, 484, 491; 52/66, 70; 434/245; 135/87, 96; 256/25; D6/331; D21/506

[56] References Cited

U.S. PATENT DOCUMENTS

| | | | |
|---|---|---|---|
| 2,310,738 | 2/1943 | Johnston . | |
| 2,608,726 | 9/1952 | Olson | 20/2 |
| 2,734,307 | 2/1956 | Oravets . | |
| 3,188,661 | 6/1965 | Rudy . | |
| 3,231,942 | 2/1966 | O'Brien | 52/70 |
| 3,694,974 | 10/1972 | Eckel . | |
| 3,977,119 | 8/1976 | Nelson | 46/12 |
| 4,236,335 | 12/1980 | Colonneau . | |
| 4,551,114 | 11/1985 | Hyman et al. . | |
| 4,696,652 | 9/1987 | Reeder et al. | 446/75 |
| 4,935,976 | 6/1990 | Milman . | |
| 4,964,249 | 10/1990 | Payne | 52/70 |
| 5,301,478 | 4/1994 | Maese, Jr. | 52/66 |
| 5,803,786 | 9/1998 | McCormick . | |
| 5,853,332 | 12/1998 | Briggs . | |
| 5,897,325 | 4/1999 | Koby-Olson . | |

*Primary Examiner*—Kien T. Nguyen
*Assistant Examiner*—Laura Fossum
*Attorney, Agent, or Firm*—Joseph N. Breaux

[57] ABSTRACT

A playhouse with story telling function comprises a miniature church structure adapted for children to play in. A means within the miniature church structure is for reproducing music and messages for the children, while the children are playing within the miniature church structure.

1 Claim, 2 Drawing Sheets

PLAYHOUSE WITH STORY TELLING FUNCTION

TECHNICAL FIELD

The present invention relates to playhouses for children and more particularly to a playhouse with story telling function. The playhouse with story telling function is designed in the shape of a church for young children of Christian families that will help reinforce the families' faith and religious beliefs. The playhouse with story telling function features a built-in push-button audio system that is used to play religious music, wedding music or any prerecorded messages of music.

BACKGROUND ART

Numerous playhouses for children have been provided in prior art. For example, U.S. Pat. Nos. 2,608,726 to Olson; 3,231,942 to O'Brien; 3,977,119 to Nelson; 4,696,652 to Reeder et al.; 4,964,249 to Payne and 5,301,478 to Maese, Jr. all are illustrative of such prior art. While these units may be suitable for the particular purpose to which they address, they would not be as suitable for the purposes of the present invention as heretofore described.

The Olson U.S. Pat. No. 2,608,726 discloses a collapsible toy building. The invention is to provide a toy building in the form of a church, this being sufficiently large to accommodate a child, but being collapsible to a compact folded position, so that it may be conveniently stored away, when it is not in use.

The O'Brien U.S. Pat. No. 3,231,942 discloses a playhouse. The present invention is to provide a novel and improved children's playhouse adapted for use either indoors or outdoors which is characterized by structure which enables it to be readily erected or collapsed for use or storage.

The Nelson U.S. Pat. No. 3,977,119 discloses a collapsible playhouse made of two equal parts. The simple collapsible playhouse of substantial dimensions made of rigid material which can be easily folded for storage or easily opened for use by anyone including small children. The playhouse can be made of two equal parts which when properly taped or hinged together form a complete playhouse.

The Reeder et al. U.S. Pat. No. 4,696,652 discloses a portable, foldable replica of a facade of commercial establishments. This replica device or toy is structured to suggest commercial establishments such as a post office, bank, hotel, and the like. This replica device is made with a main and two side-hinged panel members with outward-swinging Limiting means. The device, when open for use, has a selectively open and closed window, shelf and box door. Signs indicating the establishment's represented usage are also provided. Bank teller apparatus and post office rental boxes are provided. A minimum of loose components is shown, but accessories are provided so that children may use this device with a minimum of imagination. In storage condition, this device is about suitcase size and of light weight. This device is intended for use by two or more grade school children.

The Payne U.S. Pat. No. 4,964,249 discloses a foldable playhouse with container-forming roof. The foldable children's playhouse having a box beam integral with one or two roof panels is disclosed. The box beam has a U-shaped cross section, with the integral panels being foldable along a line extending longitudinally at the open end of the box beam. In a preferred embodiment, walls of the playhouse are made up of two units, each including a rectangular side wall and an end wall having a rectangular bottom portion and a triangular cable portion that folds along the top of the bottom portion. The roof is attachable to the walls by placing it in alignment over the waits and engaging top edges of the walls with channels on the underside of the roof so as to obtain a force fit. Means such as Velcro fasteners are provided on overlapping surfaces for securing the wall units to one another. A rail for strengthening the roof is disposed around the edges of and underneath the roof, the rail being obtained by folding over of edge regions to provide a support member having a triangular cross section. The box beam and integral panels when folded flat form a receptacle for containing the wall panel units in folded, stacked position.

The Maese, Jr. U.S. Pat. No. 5,301,478 discloses a child's playhouse. The child's playhouse includes interfolded panels arranged for ease of assembly relative to one another, including hinged interconnection, wherein the top wall includes a pop-up plate having an accordion pleated member extending between the pop-up plate and the top wail to provide for ease of projection of a structure relative to the top wall.

GENERAL SUMMARY DISCUSSION OF INVENTION

The playhouse with story telling function consists of a children's playhouse having the general shape and appearance of a church. It includes a steeple with a ringing bell having a line that extends into the internal area of the playhouse. An automatic push-button audio system installed within one of the panels of the playhouse allows a child to select from a number of religiously based stories for entertainment while playing in the playhouse. The stories are preferably on a digital media and can be updated by inserting a different media card or compact disc into a playback system that is accessible through a panel having a lock to prevent the child from playing secular type, compact discs on the playback system without the parents approval.

A primary object of the present invention is to provide a playhouse with story telling function that will overcome the shortcomings of the prior art devices.

Another object is to provide a playhouse with story telling function that is in the shape of a church for young children of Christian families, to help reinforce the families' faith and religious beliefs.

An additional object is to provide a playhouse with story telling function that will feature a built-in push-button audio system used to play religious music, wedding music or any prerecorded messages or music.

A further object is to provide a playhouse with story telling function that is simple and easy to use.

A still further object is to provide a playhouse with story telling function that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
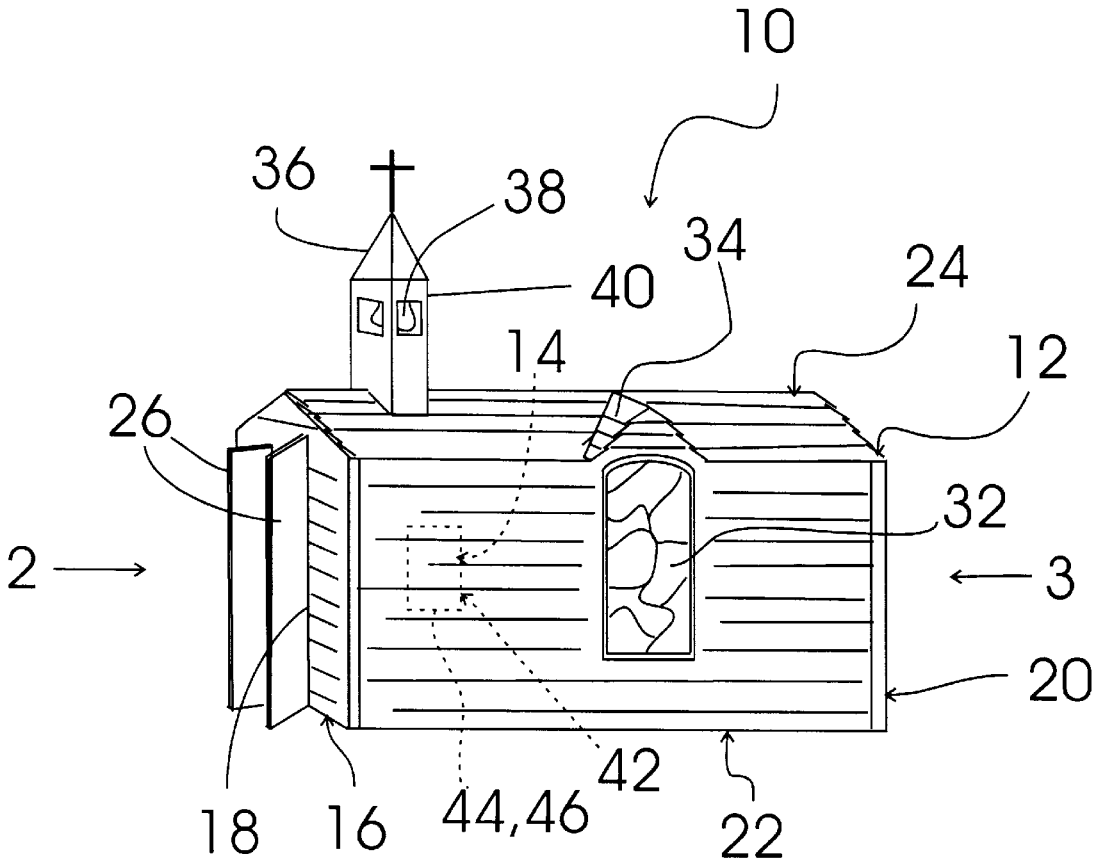
FIG. 1 is a perspective view of the present invention.
Figure 4:
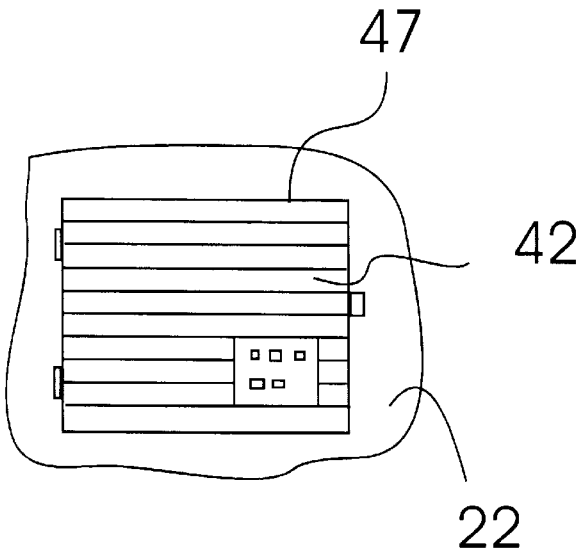
FIG. 4 is an exploded view of the small box (47) of FIG. 1.
Figure 3:
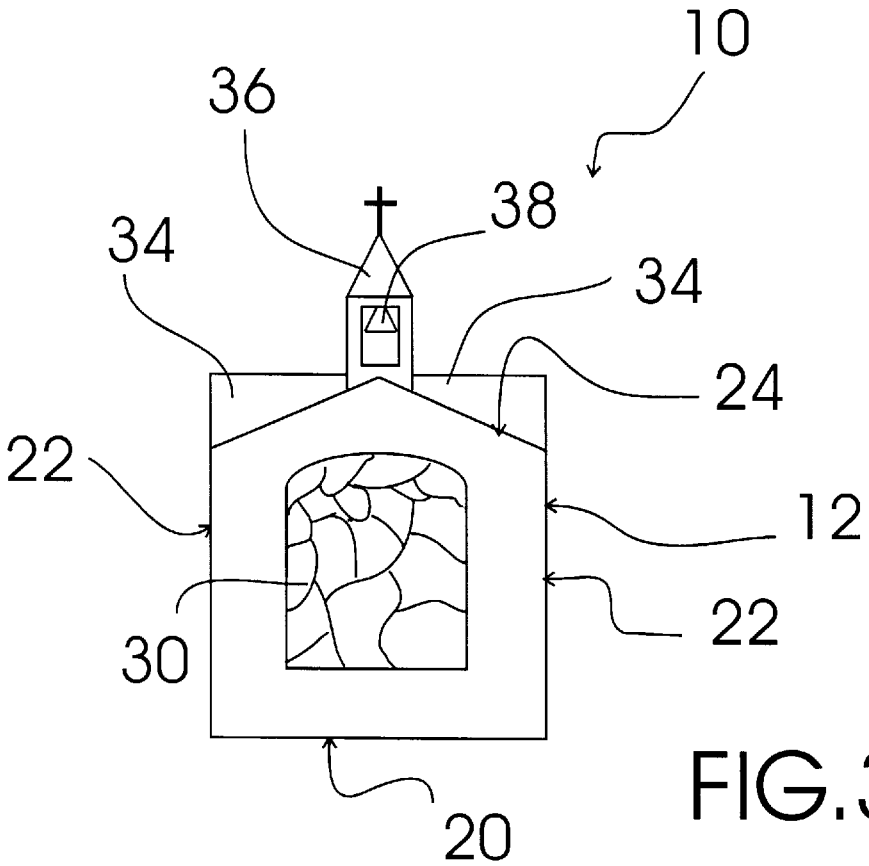
FIG. 3 is a diagrammatic rear elevational view taken in the direction of arrow 3 in FIG. 1.
Figure 2:
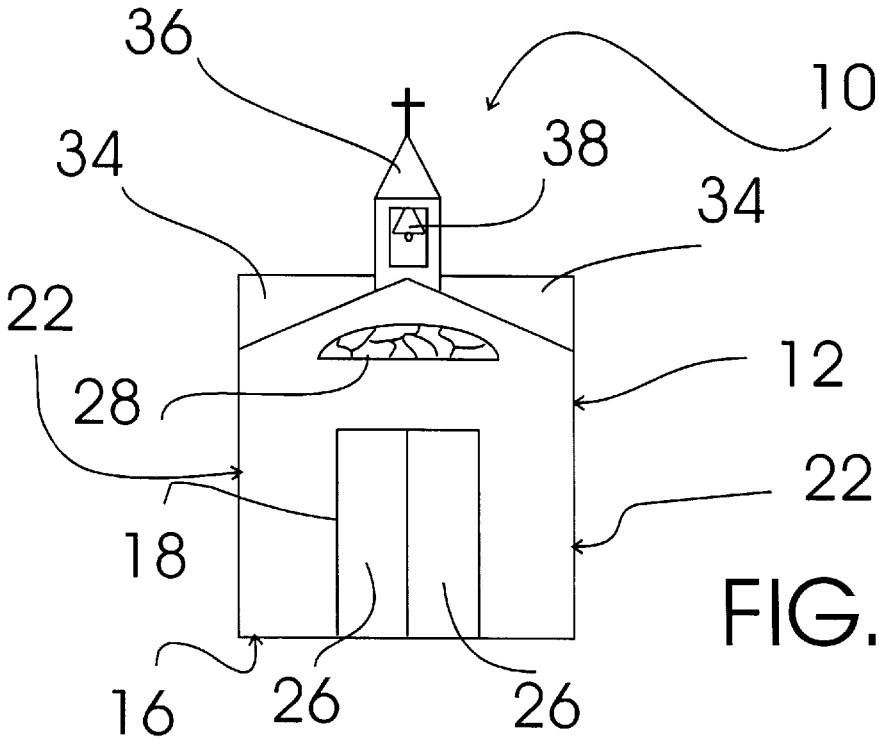
FIG. 2 is a diagrammatic front elevational view taken in the direction of arrow 2 in FIG. 1.

Turning now descriptively to the drawings, in which similar reference characters denote similar elements throughout the several views, FIGS. 1 through 3 illustrate the various features of the present invention being a playhouse with story telling function 10 comprising a miniature church structure 12 adapted for children to play in. A means 14 within miniature church structure 12 is for reproducing music and messages for the children, while the children are playing within the miniature church structure 12.

Miniature church structure 12 includes a front wall panel 16 having an entryway 18, a rear wall panel 20, a pair of side wall panels 22 connected at front and rear edges thereof to respective front wall panel 16 and rear wall panel 20. A roof member 24 is also provided. Front wall panel 16 includes a set of double door plates 26 hinged within entryway 18 to open outwardly. A simulated stained glass window 28 is above the set of double door plates 26. Rear wall panel 20 also contains a simulated stained glass window 30, while each side wall panel 22 has a simulated stained glass window 32.

Roof member 24 includes two small gables 34 and a steeple 36 thereon. The steeple 36 contains a bell 38 suspended therein. A line 40 is connected to the bell 38 which hangs down into interior of the miniature church structure 12, so that children within the miniature church structure 12 can pull line 40 to ring the bell 38 at will.

Reproducing means 14 is a push-button audio system 42 installed on interior surface of one side wall panel 22 adjacent front wall panel 16, to allow children to select the music and messages therefrom. Push-button audio system 42 can be a battery operated cassette player 44. Push-button audio system 42 can also be a battery operated compact disc player 46.

The playhouse with story telling function 10 can be fabricated of plastic panels that connected together and form a small play church. The playhouse with story telling function 10 embodies a steeple 36 with a bell 38 and two small gables 34 on top of the roof member 24, a set of double door plates 26 in the front wall panel 16, a large plastic stained glass window 30 in the rear wall panel 20, and a small plastic stained glass window 32 in each of the side wall panels 22. The bell 38 is connected to a short piece of line 40 hanging into the interior of the miniature church structure 12, so that the children can ring it at will. A small box 47 with a latchable closing door incorporating a grill is attached to the inside of one of the side wall panels next to the set of double door plates 26. This box serves to contain the push-button audio system 42 that is used to play religious music, play wedding music, or any prerecorded messages or music for the children while playing in the miniature church structure 12. The playhouse with story telling function 10 can be manufacture in various sizes and colors. The playhouse with story telling function 10 could also be manufactured as a smaller play set type toy with removable pieces. No matter what the size, the wholesome play theme would remain the same. The design of the playhouse with story telling function 10 would allow it to easily be disassembled for compact storage when not in use.

It can be seen from the preceding description that in use, anyone of Christian faith who desires wholesome, faith reinforcing toys for their children would simply purchase the playhouse with story telling function 10, and place it in the playroom or yard. The push-button audio system 42 would be used as des red to provide music or any message for the children while playing in the playhouse with story telling function 10. The children would enjoy the benefit of having a play church for their use that would provide hours of mentally nourishing fun.

It is noted that the embodiment of the playhouse with story telling function described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A playhouse with story telling function comprising:

a push-button audio system having prerecorded selections; and a structure configured and designed to simulate a traditional church building, sized such that children fit entirely within and play entirely within said structure itself, said structure having double door plates, side wall panels adjacent to said double door plates, and a small box having a latchable closing door incorporating a grill within which said push button audit system is locked to prevent children from altering the prerecorded selections.

* * * * *